US012429049B2

(12) United States Patent
Buttnor et al.

(10) Patent No.: US 12,429,049 B2
(45) Date of Patent: Sep. 30, 2025

(54) LUBRICATOR ASSEMBLY WITH FLANGE OR FLOW BLOCK MOUNTED CATCHER

(71) Applicant: Tier 1 Energy Solutions, Inc., Edmonton (CA)

(72) Inventors: Clinton Buttnor, Sylvan Lake (CA); Mathys Lourens Geldenhuys, Brooks (CA)

(73) Assignee: Tier 1 Energy Solutions, Inc., Edmonton (CA)

( * ) Notice: Subject to any disclaimer, the term of this patent is extended or adjusted under 35 U.S.C. 154(b) by 0 days.

(21) Appl. No.: 18/531,302

(22) Filed: Dec. 6, 2023

(65) Prior Publication Data

US 2025/0035108 A1 Jan. 30, 2025

Related U.S. Application Data

(60) Provisional application No. 63/484,254, filed on Feb. 10, 2023, provisional application No. 63/430,535, filed on Dec. 6, 2022.

(51) Int. Cl.
*F04B 53/18* (2006.01)
*F04B 47/00* (2006.01)

(52) U.S. Cl.
CPC ..... *F04B 53/18* (2013.01); *F04B 47/00* (2013.01)

(58) Field of Classification Search
CPC ..... E21B 43/121; E21B 33/068
See application file for complete search history.

(56) References Cited

U.S. PATENT DOCUMENTS 1,815,364 A 7/1931 Ricker
1,836,872 A 12/1931 Ricker
1,836,874 A * 12/1931 Ricker ..... F04B 47/12 417/58
1,836,875 A * 12/1931 Ricker ..... F04B 47/12 417/58
1,836,876 A 12/1931 Ricker
1,836,877 A 12/1931 Ricker
1,836,912 A 12/1931 Fletcher
1,844,074 A 2/1932 Ricker
1,846,002 A 2/1932 Fletcher
1,896,232 A 2/1933 Fletcher
1,909,119 A 5/1933 Ricker
1,919,547 A 7/1933 Fletcher
1,922,427 A 8/1933 Fletcher
1,932,451 A 10/1933 Seth
1,932,452 A 10/1933 Seth
1,932,480 A 10/1933 Ricker
(Continued)

FOREIGN PATENT DOCUMENTS

CA 2938689 A1 2/2017
CA 2933313 A1 12/2017
(Continued)

OTHER PUBLICATIONS

Kaizen Well Solution, Radial Flow Lubricator, product specification information (2023) pp. 1-2.
(Continued)

*Primary Examiner* — David Carroll
(74) *Attorney, Agent, or Firm* — Bennett Jones LLP

(57) ABSTRACT

A lubricator for receiving a reciprocating plunger has a catcher mounted in a lower flange, or in an integral flow block.

13 Claims, 6 Drawing Sheets

(56) References Cited

U.S. PATENT DOCUMENTS

| | | | | |
|---|---|---|---|---|
| 1,932,500 | A | 10/1933 | Woods | |
| 1,932,962 | A | 10/1933 | Fletcher | |
| 1,932,963 | A | 10/1933 | Fletcher | |
| 1,932,992 | A | 10/1933 | Sherman et al. | |
| 1,947,511 | A | 2/1934 | Baggett | |
| 2,001,551 | A | 5/1935 | Scott | |
| 2,001,552 | A | 5/1935 | Scott | |
| 2,013,111 | A | 9/1935 | Scott | |
| 2,030,436 | A * | 2/1936 | Fletcher | F04B 47/12 166/372 |
| 2,038,426 | A | 4/1936 | Fletcher | |
| 2,057,425 | A | 10/1936 | Fletcher | |
| 2,064,272 | A | 12/1936 | Scott | |
| 2,160,291 | A | 5/1939 | Scott | |
| 2,172,636 | A | 9/1939 | Coberly | |
| 2,573,177 | A | 10/1951 | Bohlen | |
| 5,012,864 | A | 5/1991 | Enright | |
| 5,577,560 | A | 11/1996 | Coronado et al. | |
| 9,850,731 | B2 | 12/2017 | Maerz et al. | |
| 11,208,874 | B2 | 12/2021 | Murdoch et al. | |
| 12,018,551 | B2 | 6/2024 | Murdoch et al. | |
| 2009/0261575 | A1 | 10/2009 | Bull et al. | |
| 2009/0308691 | A1 | 12/2009 | Commins et al. | |
| 2010/0243247 | A1 | 9/2010 | Cherewyk | |
| 2013/0020091 | A1 * | 1/2013 | Maerz | E21B 43/121 166/90.1 |
| 2014/0090830 | A1 | 4/2014 | Maerz et al. | |
| 2014/0262302 | A1 | 9/2014 | Ferguson et al. | |
| 2015/0107823 | A1 | 4/2015 | Gronning | |
| 2015/0176377 | A1 * | 6/2015 | Agarwal | E21B 17/07 166/372 |
| 2016/0097265 | A1 | 4/2016 | Bishop | |
| 2016/0341195 | A1 * | 11/2016 | Roycroft | E21B 33/068 |
| 2017/0044881 | A1 | 2/2017 | Lynch | |
| 2017/0044882 | A1 * | 2/2017 | Casey | E21B 33/03 |
| 2017/0342792 | A1 | 11/2017 | McHugh | |
| 2019/0234191 | A1 | 8/2019 | Murdoch et al. | |
| 2020/0102803 | A1 | 4/2020 | Ruppert et al. | |
| 2020/0131889 | A1 | 4/2020 | Robinson et al. | |
| 2022/0290499 | A1 | 9/2022 | Geldenhuys et al. | |
| 2024/0240663 | A1 * | 7/2024 | Sutherland | E21B 43/121 |

FOREIGN PATENT DOCUMENTS

| | | | |
|---|---|---|---|
| CA | 3170189 | A1 | 7/2019 |
| CA | 3031997 | C | 10/2022 |

OTHER PUBLICATIONS

Aro, Aro-Flo Mist Type Lubricator, online catalogue (2024) USA.
Definitive Optimization, 2 3/8 EUE 8 RD Threated Lubricator, product specification information pp. 1-2.
Definitive Optimization, Smart Flow Technology "Dual Valve Lubricator", product specification information pp. 1-2.
Hoistrad Vacuum Technology, Flange Double-Sided Radial Ports NW35CF, online catalogue (2024).
Definitive Optimization, 10K Concentric Flow Lubricator, product specification information (2019) pp. 1-2.

* cited by examiner

LUBRICATOR ASSEMBLY WITH FLANGE OR FLOW BLOCK MOUNTED CATCHER

FIELD OF THE INVENTION

The present invention generally relates to an improved lubricator for a plunger lift system.

BACKGROUND

Plunger lift systems are deployed in oil and gas wells where water may accumulate in the well when gas flow from formation is insufficient to remove liquids from the well naturally. As the formation pressure declines and the gas-to-liquid ratio decreases, liquid (generally water) will begin to accumulate in the well. When a produced water column in the wellbore reaches a sufficient height, the resulting hydrostatic pressure will exert pressure on the formation, hindering hydrocarbon flow from the formation up to surface. To overcome this, the water may be removed from the well using an artificial lift system, such as a plunger lift system. In a plunger lift system, a plunger deployed in the wellbore acts as a piston within the production tubing inner wall to drive liquid up to the surface. Gas pressure from below the plunger drives it and the water column above it toward the surface, where the water can be removed, thereby alleviating the pressure on the formation from the water column. This function is performed cyclically, typically without operator intervention. The fluid driven upwards by the plunger is ejected through a lubricator which is installed on the top of the wellbore, which has exit ports connected to wellhead equipment to receive and process the fluids.

Conventionally, when the plunger is pushed to the top of the lubricator, it may be captured by a plunger catcher either for removal, delayed dropping with an autocatcher, or to trip a valve style plunger. As shown in prior art FIG. 1, a conventional catcher is threaded into the lubricator body, and has a bullet which moves radially, transverse to the longitudinal bore of the lubricator.

SUMMARY OF THE INVENTION

In one aspect, disclosed is a plunger lubricator comprising:

(a) a lubricator body defining an internal longitudinal bore (b) an upper lubricator assembly capping an upper end of the lubricator body;

(c) a flange for mounting the lubricator body to a wellhead component, the flange defining a bore aligned with the lubricator body bore; and (d) a plunger catcher positioned within the flange.

In another aspect, disclosed is a plunger lubricator comprising a catcher installed in a widest and lowest portion of the lubricator.

In another aspect, disclosed is a plunger lubricator comprising a lubricator body having an integral flow block and a concentric sleeve, wherein the concentric sleeve is disposed within a longitudinal bore extending through the body and flow block, and a catcher disposed in the flow block, below a bottom end of the concentric sleeve.

BRIEF DESCRIPTION OF THE FIGURES

The accompanying drawings, which are incorporated herein and form a part of the specification, illustrate some, but not the only or exclusive, examples of embodiments and/or features.

DETAILED DESCRIPTION

Figure 1:
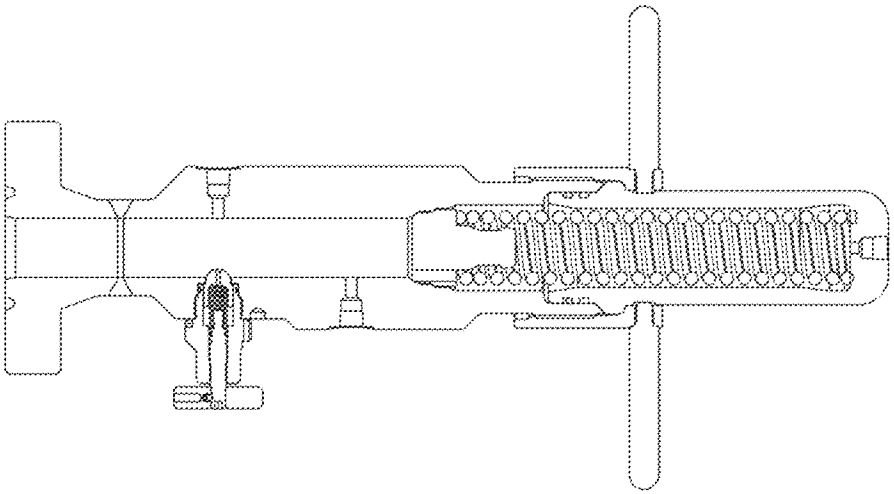
FIG. 1 (Prior Art)
FIG. 1 shows an example of a prior art lubricator and catcher.

The present invention now will be described more fully hereinafter with reference to the accompanying drawings, in which some, but not all embodiments of the invention are exemplified. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation. Conventional components of the invention are elements that are well-known in the prior art and will not be discussed in detail for this disclosure.

FIG. 1 shows an example of a prior art lubricator, where the plunger catcher is positioned in the lubricator body. Due to design and space limitations, a catcher is often placed rather high in the lubricator. This configuration has certain disadvantages. Plungers with low velocity or pushing a larger volume of fluid may sometimes stall and have difficulty being caught by the catcher. The plunger must reach the top of the lubricator in order to engage the catcher.

Ports for installing a catcher in lubricator body require a substantial wall thickness for adequate thread engagement, seal bore, and bullet support. Thus, the lubricator body must have a thicker wall in order to support the installation of the catcher, which is threaded into the lubricator body radially. The limited radial dimension means the catcher bullet is shorter and the bullet bore offers less support to the bullet than if the bullet were to be longer.

Figure 2:
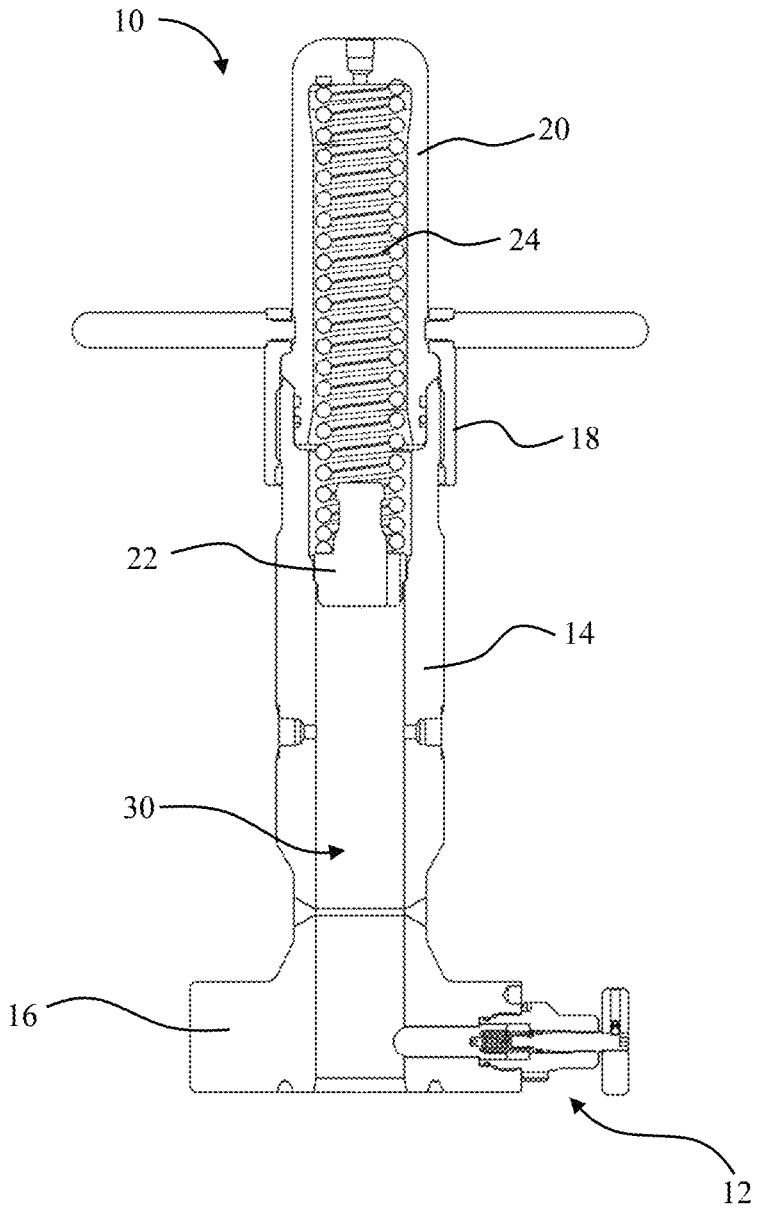
FIG. 2 shows longitudinal cross-section of one embodiment of a lubricator.

FIG. 2 shows one embodiment of an improved lubricator 10 provided by the present disclosure. The lubricator 10 has a catcher 12 mounted in a flange 16 portion of the lubricator 10. The lubricator body 14 comprises an upper lubricator assembly, comprising a nut 18, spring cap 20, a spring 24, and an anvil 22. The anvil 22 provides a travel stop for a plunger received into the lubricator, and the spring 24 may serve to cushion the impact. Because the lubricator body 14 does not need to support the catcher 12, it may be fashioned with a thinner wall with a resulting smaller diameter.

Figure 3:
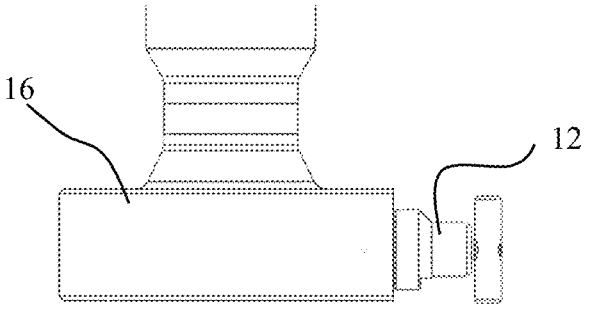
FIG. 3 is a side plan view of a flange.

The flange 16 is typically a component that is welded to the lubricator body 14 to form the lubricator 10, and serves as attachment means to mount the lubricator 10 to a wellhead component, such as a flow block (not shown). The flange 16 must have sufficient depth (measured in the vertical direction in FIG. 2) to mount a catcher, which may be of variable size. For example, as shown in FIG. 3, the flange has a depth of 3.25 inches to accommodate a catcher having a diameter of approximately 2.5 inches.

The flange 16 has a much larger radial dimension than the lubricator body 14, thus the catcher 12 is positioned farther away from the longitudinal centreline of the internal bore 30 which passes through the flange 16 and the lubricator body 14, than if the catcher is installed in the lubricator body 14.

Thus configured, in one embodiment, the catcher 12 is positioned in the widest and lowest portion of the lubricator 10.

Figure 4:
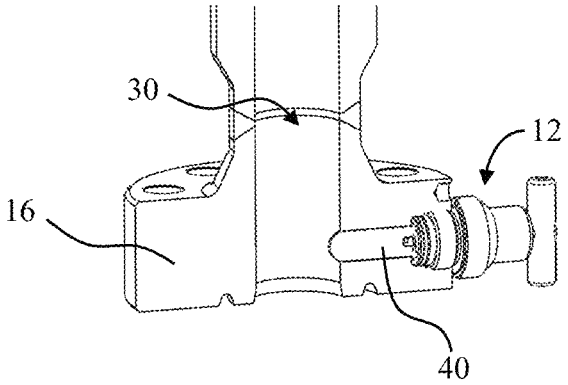
FIG. 4 is a longitudinal cross-section of the flange of FIG. 3.
Figure 5:
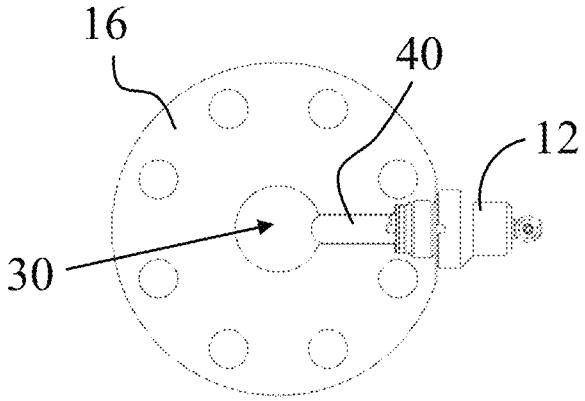
FIG. 5 is a horizontal cross section of the flange of FIG. 3.

As shown in FIGS. 4 and 5, the catcher 12 will have a longer bullet 40, which has additional support when extended in the bullet cavity which intersects the internal bore 30.

Figure 6:
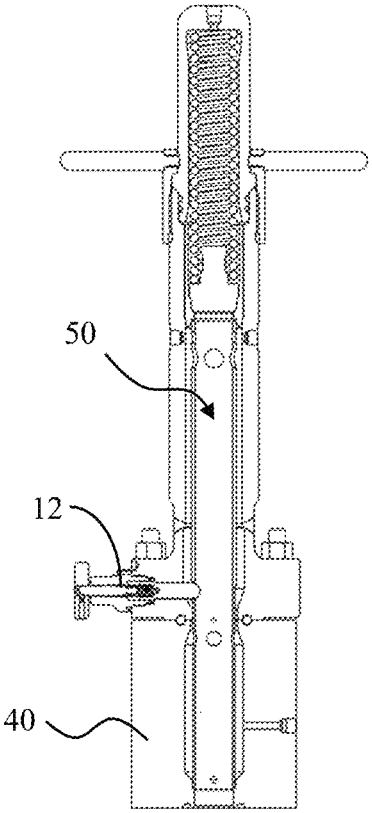
FIG. 6 is longitudinal cross-section of a lubricator of FIG. 2, where the flange is bolted to a flow block and including a concentric sleeve.

In one embodiment, exemplified in FIG. 6, the lubricator having a flange-mounted catcher 12 is mounted (bolted) to a cross-block or flow block 40. An inner concentric sleeve 50 is disposed in the flow block 40 and extends upwards into the lubricator body, as described in co-pending U.S. application Ser. No. 17/692,849, filed Mar. 11, 2022 and entitled "Full Sleeve Concentric Lubricator".

Figure 7:
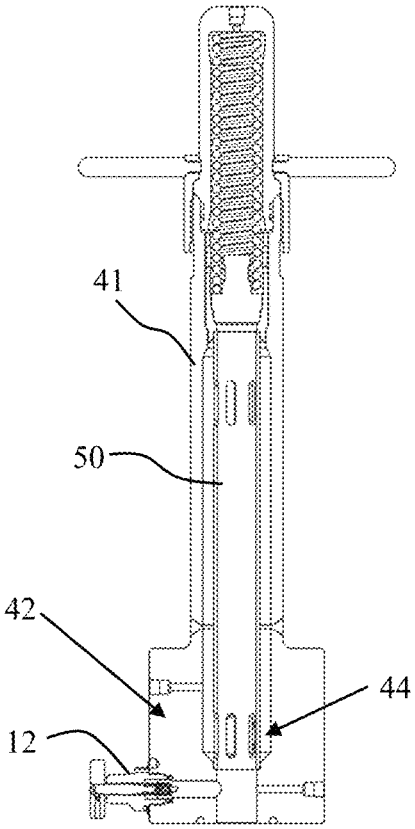
FIG. 7 is a longitudinal cross-section of one embodiment of a lubricator body having an integral flow block, where a catcher is disposed below a bottom end of a concentric sleeve.
Figure 8:
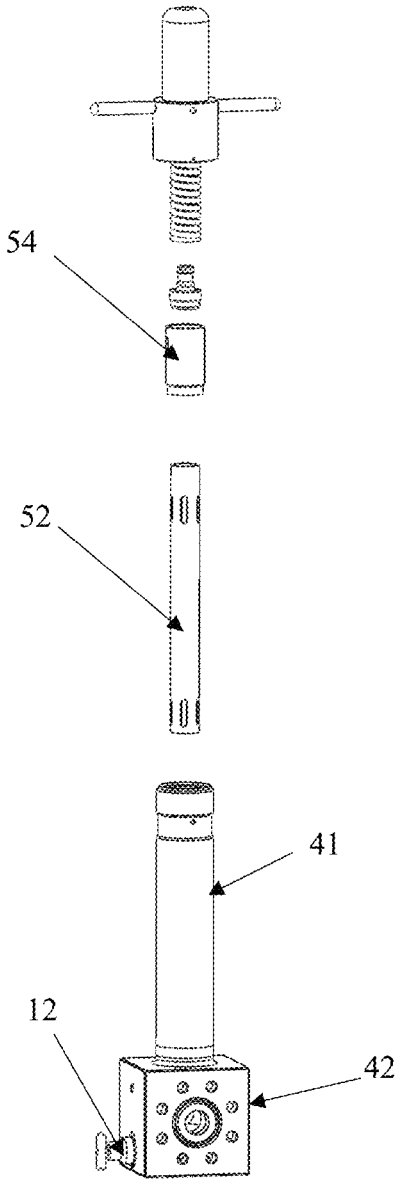
FIG. 8 shows a exploded view of the embodiment of FIG. 7.

In some embodiments, the lubricator body comprises an upper cylindrical portion 41 and an integral flow block 42. The flow block 42 is welded to the upper cylindrical portion 41 to form an integral one-piece lubricator body, as is exemplified in FIG. 7. Accordingly, the catcher 12 is positioned within the flow block portion 42, and preferably below the bottom of the concentric sleeve 50, which rests on a shoulder 44 formed in the central bore of the integrated lubricator/flow block. Thus, the catcher is mounted in the widest and lowest part of the lubricator body.

As a result, the catcher 12 is no longer located in the upper cylindrical portion 41 of the lubricator body, which reduces the amount of material required to form the cylindrical portion 41. Furthermore, placing a catcher port in the flow block 42 allows a thick amount of material available for the catcher port. In preferred embodiments, the catcher 12 does not pass through the concentric sleeve 50, thus, it is not necessary to align the concentric sleeve with the catcher, and the catcher need not be removed in order to remove the sleeve. The sleeve is easier to remove and install since the catcher is not passing through the sleeve.

Figure 9:
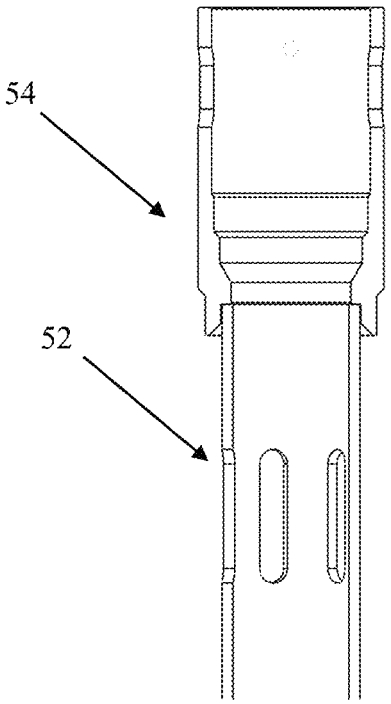
FIG. 9 is a detailed view of the connection between the concentric sleeve and upper striker pad housing.
Figure 10:
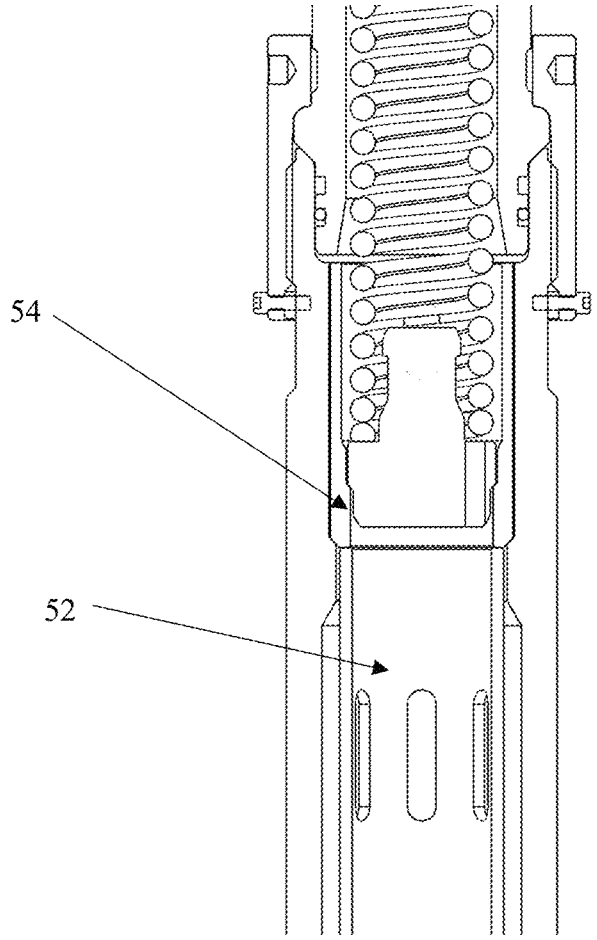
FIG. 10 shows a longitudinal cross-section of a portion of one embodiment of a lubricator.

In some embodiments, the full concentric sleeve has a novel two-piece configuration, comprising a cylindrical portion 52 and an upper striker pad housing 54. The lowest wear area is generally at the top of concentric sleeve, and a two-piece configuration allows the higher-wear portion (cylindrical portion 52) to be replaced independent of the striker pad housing. In some embodiments, the upper end of the cylindrical portion 52 fits into a beveled guide and seat within the reusable striker pad housing 54, as exemplified in FIG. 9. The cylindrical portion 52 may be produced from stock pipe, and need not use lathing and milling operations. In other embodiments, as exemplified in FIG. 10, the top of the concentric sleeve 52 abuts upper striker pad housing 54. In this case, the concentric sleeve 52 and pad housing 54 may be aligned by means of bevelled portion 58, on the inside of the lubricator body.

Interpretation.

The forgoing description supplies specific details in order to provide a thorough understanding. Nevertheless, the skilled artisan would understand that the apparatuses, systems, and associated methods of using the apparatuses and systems can be implemented and used without employing these specific details. Indeed, the apparatuses, systems, and associated methods can be placed into practice by modifying the illustrated apparatus and associated methods and can be used in conjunction with any other apparatus and techniques conventionally used in the industry.

The corresponding structures, materials, acts, and equivalents of all means or steps plus function elements in the claims appended to this specification are intended to include any structure, material, or act for performing the function in combination with other claimed elements as specifically claimed.

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such module, aspect, feature, structure, or characteristic with other embodiments, whether or not explicitly described. In other words, any module, element or feature may be combined with any other element or feature in different embodiments, unless there is an obvious or inherent incompatibility, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio.

The invention claimed is:

1. A plunger lubricator comprising:

(a) a lubricator body defining an internal longitudinal bore;

(b) an upper lubricator assembly capping an upper end of the lubricator body;

(c) a lower flange or flow block for mounting the lubricator body to a wellhead component, the flange or flow block defining a bore aligned with the lubricator body bore; and (d) a plunger catcher positioned within the lower flange or flow block.

2. The plunger lubricator of claim 1 wherein the lower flange is the widest and/or lowest portion of the lubricator.

3. The plunger lubricator of claim 1 comprising a one-piece integral lubricator body comprising an upper cylindrical portion and the lower flow block.

4. The plunger lubricator of claim 1 comprising a one-piece integral lubricator body comprising an upper cylindrical portion and the lower flange.

5. The plunger lubricator of claim 3 further comprising a concentric sleeve disposed in the longitudinal bore, and having a lower end disposed within the flow block, wherein the catcher is disposed below the lower end of the concentric sleeve.

6. The plunger lubricator of claim 5, wherein the concentric sleeve comprises a cylindrical portion and an upper striker pad housing.

7. The plunger lubricator of claim 6 wherein an upper end of the cylindrical portion fits into a beveled guide and seat within the striker pad housing.

8. The plunger lubricator of claim 6 wherein the concentric sleeve abuts the upper striker pad housing.

9. The plunger lubricator of claim 6 wherein the cylindrical portion is produced from stock pipe.

10. A plunger lubricator comprising a catcher installed in a widest and lowest portion of the lubricator used for mounting the lubricator to a wellhead component.

11. The plunger lubricator of claim 2 wherein the lower flange is the widest and lowest portion of the lubricator.

12. The plunger lubricator of claim 1 comprising a flow block for mounting the lubricator body to the wellhead and wherein the plunger catcher is mounted in the flow block.

13. The plunger lubricator of claim 12 further comprising a concentric sleeve disposed in the longitudinal bore, and having a lower end disposed within the flow block, wherein the plunger catcher is disposed below the lower end of the concentric sleeve.

* * * * *